US010684585B2

(12) United States Patent
Miyagawa et al.

(10) Patent No.: US 10,684,585 B2
(45) Date of Patent: Jun. 16, 2020

(54) CLEANING BLADE

(71) Applicant: Sumitomo Riko Company Limited, Aichi (JP)

(72) Inventors: Shimpei Miyagawa, Aichi (JP); Toshihiko Arata, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 0 days.

(21) Appl. No.: 16/568,259

(22) Filed: Sep. 12, 2019

(65) Prior Publication Data

US 2020/0004195 A1 Jan. 2, 2020

Related U.S. Application Data

(63) Continuation of application No. PCT/JP2018/011236, filed on Mar. 21, 2018.

(30) Foreign Application Priority Data

Mar. 28, 2017 (JP) ..... 2017-062490

(51) Int. Cl.
*G03G 21/10* (2006.01)
*G03G 21/00* (2006.01)

(52) U.S. Cl.
CPC ..... *G03G 21/0029* (2013.01); *G03G 21/0011* (2013.01)

(58) Field of Classification Search
CPC ..... G03G 21/0011; G03G 21/0029
See application file for complete search history.

(56) References Cited

U.S. PATENT DOCUMENTS

2004/0170455 A1* 9/2004 Shintani ..... G03G 21/0011 399/350

FOREIGN PATENT DOCUMENTS

JP H11327395 11/1999

OTHER PUBLICATIONS

"International Search Report (Form PCT/ISA/210) of PCT/JP2018/011236," dated May 22, 2018, with English translation thereof, pp. 1-4.

* cited by examiner

*Primary Examiner* — Sophia S Chen
(74) *Attorney, Agent, or Firm* — JCIPRNET

(57) ABSTRACT

The disclosure provides a cleaning blade having a blade portion. The blade portion has a blade tip equipped with an edge constituted by a ridge line between the tip surface the blade portion and a blade surface arranged near a photosensitive drum. The blade portion satisfies the following expressions: a≤50 μm, and 0.1≤b/a≤0.6 where, when the blade portion is viewed along blade longitudinal direction with the edge in sliding contact with the photosensitive drum for measurement rotating in one direction, a represents a maximum amplitude of the edge which vibrates with the rotation of the photosensitive drum for measurement, and b represents a maximum amplitude when a position separated from the edge by 200 μm on the blade surface of the blade tip vibrates with the oscillation of the edge.

1 Claim, 3 Drawing Sheets

CLEANING BLADE

CROSS-REFERENCE TO RELATED APPLICATION

The present application is a continuation of PCT/JP2018/011236, filed on Mar. 21, 2018, and is related to and claims priority from Japanese patent application no. 2017-062490, filed on Mar. 28, 2017. The entire contents of each of the aforementioned applications are hereby incorporated by reference herein.

BACKGROUND

Technical Field

The disclosure relates to a cleaning blade.

Description of Related Art

A cleaning blade has been used for cleaning the surface of the photosensitive drum in an electrophotographic apparatus. The cleaning blade includes a blade portion that has an edge to be in sliding contact with the photosensitive drum, and a support that holds the blade portion. The edge of the blade portion is pressed against the surface of the photosensitive drum, so as to scrape off residual toner on the surface of the photosensitive drum that has a moving surface.

For this type of cleaning blade, for example, there is a method of applying a surface treatment to increase the hardness of the blade portion in order to improve the toner scraping property.

In addition, Patent Document 1 (Japanese Laid-Open No. H11-327395) has disclosed a cleaning blade that is configured to increase the thickness of a contact edge of the blade portion, which is against the photosensitive drum, from two ends in the longitudinal direction of the blade portion to the central part in order to achieve a constantly stable and favorable cleaning function.

However, the cleaning blade vibrates when scraping off the residual toner on the surface of the photosensitive drum. If the edge of the blade portion has an excessively large amplitude, as the toner diameter reduced in recent years, the toner may leak easily. In some cases, the blade portion may also be turned up by the photosensitive drum. Moreover, if the amplitude of the peripheral part of the edge is excessively large with respect to the amplitude of the edge of the blade portion, the vibration of the blade portion may be easily transmitted through the support, and the resonance with the main body of the electrophotographic apparatus may easily cause abnormal noise (which may be called squealing hereinafter). Further, if the amplitude of the peripheral part of the edge is excessively small with respect to the amplitude of the edge of the blade portion, chipping of the blade tip may occur easily. In addition, an excessive contact pressure on the photosensitive drum may lead to wearing of the photosensitive drum.

The disclosure provides a cleaning blade that is capable of simultaneously suppressing the leaking of toner, the turning up, squealing, and chipping of the blade portion, and wearing of the photosensitive drum.

SUMMARY

In view of above descriptions, a cleaning blade is provided capable of being used to remove residual toner that remains on a surface of a photosensitive drum in an electrophotographic apparatus. The cleaning blade includes a blade portion and a support holding the blade portion. The blade portion has a blade tip, which includes an edge constituted by a ridge line between a tip surface of the blade portion and a blade surface arranged on the side of the photosensitive drum, and the blade portion satisfies a relationship of $a \leq 50$ μm and $0.1 \leq b/a \leq 0.6$ where, when the blade portion with the edge in sliding contact with the photosensitive drum for measurement, which rotates in one direction, is viewed along a blade longitudinal direction, a represents a maximum value of an amplitude of the edge, which oscillates with rotation of the photosensitive drum for measurement, and b represents a maximum value of an amplitude when a position P that is on the blade surface of the blade tip and separate from the edge by 200 μm vibrates with vibration of the edge.

DESCRIPTION OF THE EMBODIMENTS

Figure 1:
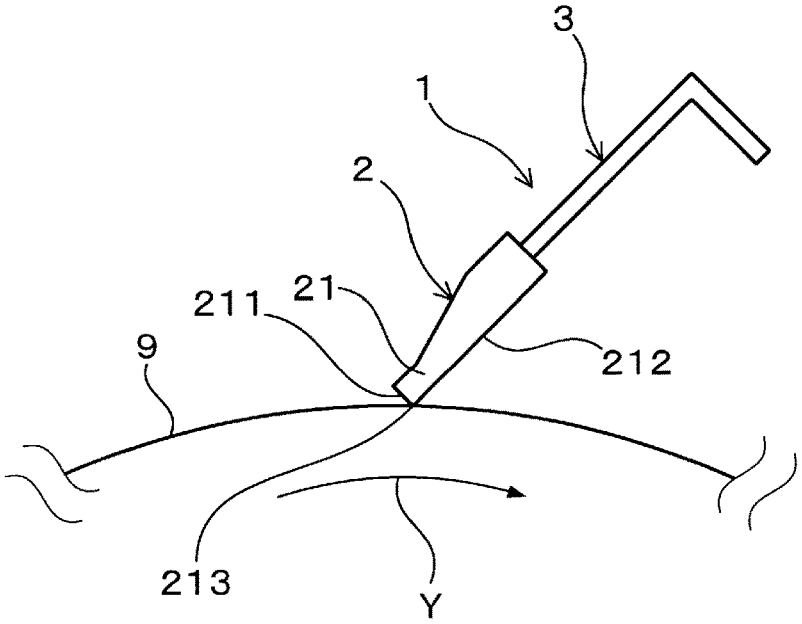
FIG. 1 is an explanatory view schematically showing an example of the state of the cleaning blade that is being used according to the first embodiment.
Figure 2:
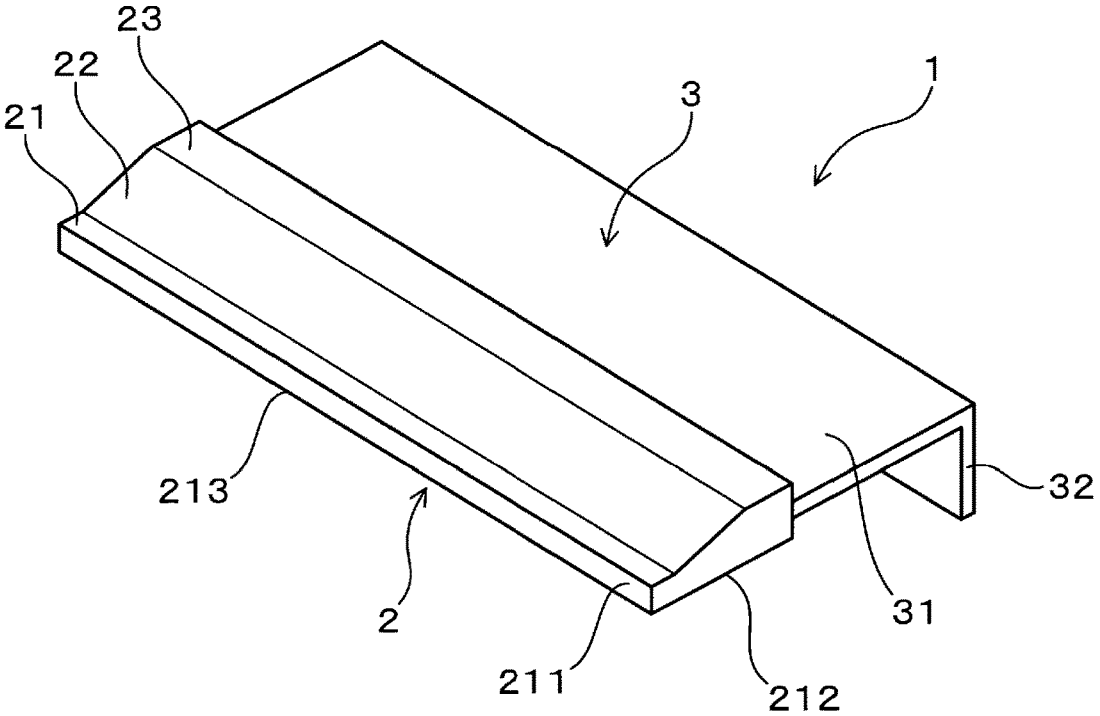
FIG. 2 is a view schematically showing the appearance of the cleaning blade according to the first embodiment as viewed obliquely from above.

The above-mentioned cleaning blade is used to remove residual toner that remains on the surface of the photosensitive drum in an electrophotographic apparatus. Specific examples of the electrophotographic apparatus include an electrophotographic copying machine using a charged image, an image forming apparatus such as a printer, a facsimile machine, a multi-function machine, an on-demand printing machine, and the like.

The cleaning blade includes a blade portion and a support that holds the blade portion. The blade portion has a blade tip including an edge that is constituted by a ridge line between a tip surface of the blade portion and a blade surface arranged on the side of the photosensitive drum.

The blade portion satisfies the relationship of $a \leq 50$ μm and $0.1 \leq b/a \leq 0.6$. When the blade portion with the edge in sliding contact with the photosensitive drum for measurement, which rotates in one direction, is viewed along the blade longitudinal direction, a is the maximum value of the amplitude of the edge that vibrates with the rotation of the photosensitive drum for measurement. b is the maximum value of the amplitude when the position P that is on the blade surface of the blade tip and separate from the edge by 200 μm vibrates with the vibration of the edge.

A photosensitive drum of the color laser printer "HP LaserJet Enterprise Color M553dn" manufactured by HP Japan is used as the photosensitive drum for measurement.

The material on the surface of the photosensitive drum is polycarbonate. If the photosensitive drum becomes obsolete and unavailable, one that has the same surface material is used. The rotational speed of the photosensitive drum for measurement is set to 100 rpm. The contact angle at which the edge of the blade portion is brought into contact with the surface of the photosensitive drum is set to 25°. The contact angle refers to an angle formed between the tangent line of the photosensitive drum on the edge and the blade surface arranged on the side of the photosensitive drum. The intrusion amount of the edge when the edge of the blade portion is brought into contact with the surface of the photosensitive drum is set to 1.0 mm. The intrusion amount refers to the distance between the edge and the point at which the blade tip of the blade portion in a natural state at a predetermined installation position intersects the surface of the photosensitive drum for measurement with respect to the photosensitive drum for measurement.

The values a and b are measured from a photographed image obtained by capturing a moving image of the blade portion with the edge in sliding contact with the photosensitive drum for measurement that rotates in one direction, as described above, along the blade longitudinal direction. The measurement environment is set to 23° C.×53% RH. However, if the size of the blade portion in the longitudinal direction is larger than the image formation region of the photosensitive drum, the measurement is performed after cutting the part that extends out of the image formation region and aligning the size of the blade portion in the longitudinal direction with the size of the image formation region in the longitudinal direction on the photosensitive drum. As viewed along the blade longitudinal direction, the vibration of the edge is basically movement along the surface of the photosensitive drum for measurement. In addition, the position P may vibrate with the vibration of the edge in various directions from the initial position that is before the drum for measurement rotates.

The value a is a value related to the leaking of toner and the turning up of the blade portion. When the value a exceeds 50 μm, the edge has an excessively large amplitude, and the leaking of toner or the turning up of the blade portion occurs easily. The value a may be set to 48 μm or less, or 45 μm or less. From the viewpoint of reducing wearing of the edge or the like, the lower limit of the value a may be set to 20 μm or more, for example.

The value b/a is a value related to the occurrence of chipping of the blade tip and wearing of the photosensitive drum. When the value b/a drops below 0.1, the amplitude at the position P that vibrates with the vibration of the edge becomes excessively small with respect to the amplitude of the edge, and an excessive contact pressure is applied on the photosensitive drum, so wearing of the photosensitive drum occurs easily. Moreover, due to deterioration of the stretch and increase of the brittleness of the blade tip, the blade tip may chip and the durability against chipping drops. The value b/a may be set to 0.15 or more, or 0.2 or more. On the other hand, when the value b/a exceeds 0.6, the amplitude at the position P that vibrates with the vibration of the edge becomes excessively large with respect to the amplitude of the edge, and squealing occurs easily during cleaning. In addition, the value b/a may be set to 0.55 or less, or 0.5 or less.

In the cleaning blade, specifically, the blade portion may be configured to have a blade base connected to the support, satisfy the relationship of $0.26 \leq A/B \leq 0.48$ and $1\ \text{mm} \leq C \leq 3$ mm, and have an international rubber hardness of 80 IRHD or more and 90 IRHD or less. A is the thickness of the blade tip at the central part in the blade longitudinal direction. B is the thickness of the blade base at the central part in the blade longitudinal direction. C is the blade surface length of the blade tip at the central part in the blade longitudinal direction.

With this configuration, a cleaning blade that is easy to ensure the above-mentioned effects is obtained. The A/B may be set to 0.26 or more and 0.45 or less, and the C may be set to 1 mm or more and 2.5 mm or less.

In the cleaning blade, specifically, the blade portion may be configured to satisfy the relationship of $A<D$. A is as described above, and D is the thickness of the blade tip at two ends in the blade longitudinal direction.

With this configuration, a cleaning blade that is easy to suppress the leaking of toner is obtained. The reasons are considered to be the following. That is, when the relationship of $A=D$ is satisfied, that is, when the thickness of the blade tip at the central part in the blade longitudinal direction and the thickness of the blade tip at two ends in the blade longitudinal direction are designed to be the same, the contact pressure that the edge applies on the photosensitive drum tends to decrease as it goes toward the sides of the two ends in the longitudinal direction of the blade portion. Therefore, in the case of the configuration of $A=D$, as the amplitude of the edge increases, the leaking of toner becomes more likely to occur on the sides of the two ends of the blade portion. However, by configuring the blade portion to satisfy the relationship of $A<D$, it is possible to increase the contact pressure on the sides at the two ends in the longitudinal direction of the blade portion. As a result, even if the value a is designed to be close to the upper limit, the leaking of toner on the sides of the two ends of the blade portion is suppressed easily, and the overall leaking of toner is suppressed easily as compared with the case where the relationship of $A=D$ is satisfied.

More specifically, the blade portion may be configured to satisfy the relationship of $1.0<D/A\leq 1.5$. With this configuration, a cleaning blade capable of sufficiently exhibiting the effect of suppressing the leaking of toner is obtained.

In addition, the configurations described above may be combined in any manner as required in order to achieve each effect described above.

EMBODIMENT

Hereinafter, embodiments of the cleaning blade will be described with reference to the drawings.

First Embodiment

The cleaning blade of the present embodiment will be described with reference to FIG. 1 to FIG. 5. As shown in FIG. 1, the cleaning blade 1 of the present embodiment is used to remove residual toner (not shown, including not only toner but also a toner external additive) that remains on the surface of the photosensitive drum 9 in the electrophotographic apparatus. The photosensitive drum 9 rotates in the direction of the arrow Y shown in FIG. 1.

As shown in FIG. 2 to FIG. 5, the cleaning blade 1 includes a blade portion 2 and a support 3 that holds the blade portion 2.

The blade portion 2 has a blade tip 21 including an edge 213 that is constituted by a ridge line between a tip surface 211 of the blade portion 2 and a blade surface 212 arranged on the side of the photosensitive drum 9.

In the present embodiment, it is illustrated that the blade portion 2 includes the blade tip 21, a blade base 23 connected to the support 3, and a blade middle portion 22 integrally connecting the blade tip 21 and the blade base 23. In the present embodiment, more specifically, the blade middle portion 22 is formed with a thickness that gradually increases from the blade tip 21 to the blade base 23. Although not shown, the blade middle portion 22 may be formed with a constant thickness from the side of the blade tip 21 to the side of the blade base 23. In the present embodiment, the blade portion 2 is made of non-foamed polyurethane rubber and has a long plate shape. Further, the thickness of the blade tip 21 is set constant in the blade longitudinal direction.

Figure 4:
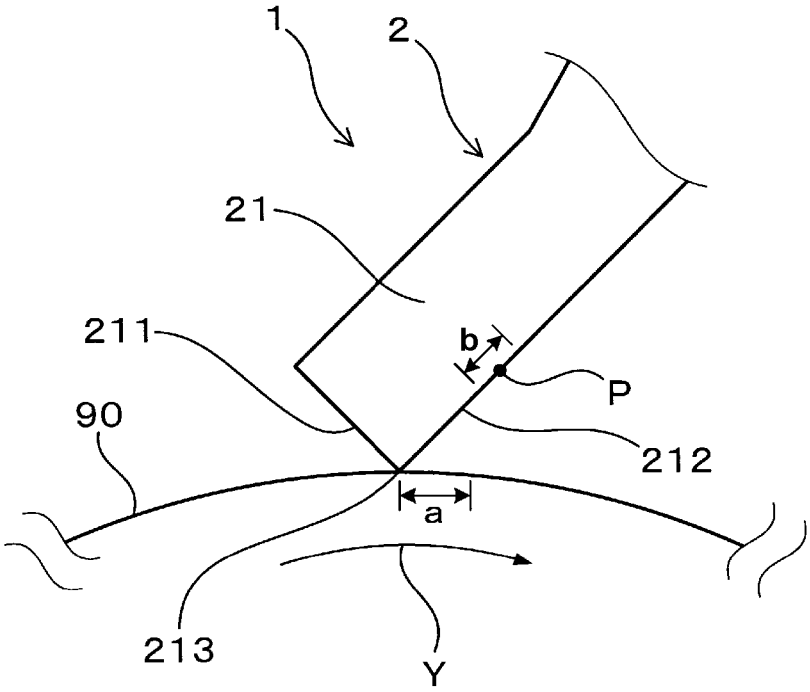
FIG. 4 is an explanatory view for schematically illustrating the configuration of the blade portion of the cleaning blade according to the first embodiment.

The blade portion 2 satisfies the relationship of $a \leq 50$ μm and $0.1 \leq b/a \leq 0.6$. As shown in FIG. 4, when the blade portion 2 with the edge 213 in sliding contact with the photosensitive drum 90 for measurement, which rotates in one direction, is viewed along the blade longitudinal direction, a is the maximum value of the amplitude of the edge 213 that vibrates with the rotation of the photosensitive drum 90 for measurement. b is the maximum value of the amplitude when the position P that is on the blade surface 212 of the blade tip 21 and separate from the edge 213 by 200 μm vibrates with the vibration of the edge 213.

Figure 5:
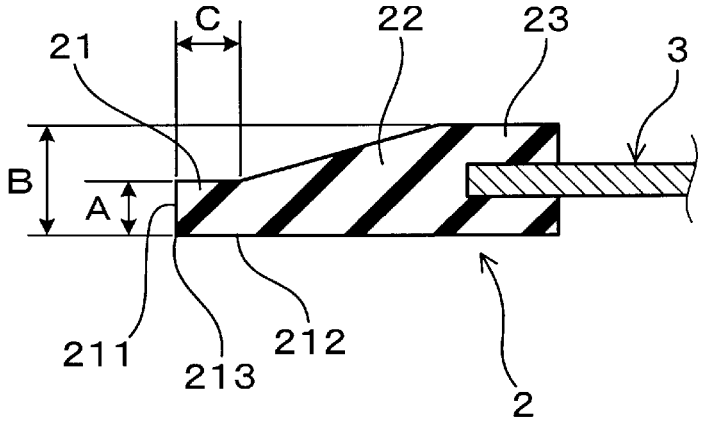
FIG. 5 is a cross-sectional view for schematically illustrating the configuration of the blade portion of the cleaning blade according to the first embodiment.

In the present embodiment, the blade portion 2 satisfies the relationship of $0.26 \leq AB \leq 0.48$ and 1 mm$\leq C \leq$3 mm, and the international rubber hardness of the blade portion 2 is 80 IRHD or more and 90 IRHD or less. As shown in FIG. 5, A is the thickness of the blade tip 21 at the central part in the blade longitudinal direction. Moreover, B is the thickness of the blade base 23 at the central part in the blade longitudinal direction. Further, C is the blade surface length of the blade tip 21 at the central part in the blade longitudinal direction.

In the present embodiment, specifically, the support 3 includes a plate-shaped portion 31 and a mounting portion 32 integrally connected to the plate-shaped portion 31. In the present embodiment, in the cleaning blade 1, the tip of the plate-shaped portion 31 of the support 3 is embedded in the rear end of the blade base 23. Although not shown, the blade portion 2 may be bonded to one plate surface of the plate-shaped portion 31 of the support 3 by an adhesive or the like.

Second Embodiment

Figure 6:
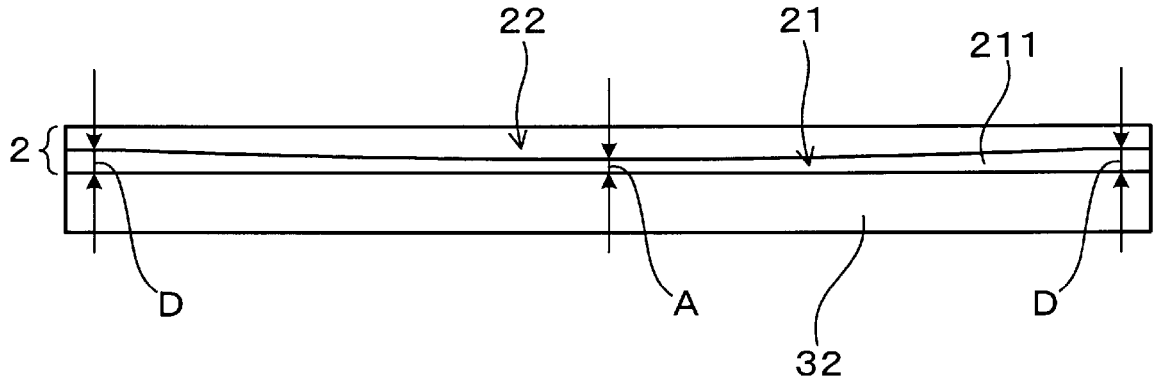
FIG. 6 is an explanatory view showing the cleaning blade according to the second embodiment corresponding to FIG. 3.

The cleaning blade of the second embodiment will be described with reference to FIG. 6. The cleaning blade 1 of the present embodiment differs from the cleaning blade 1 of the first embodiment in that the thickness of the blade tip 21 of the blade portion 2 is not constant in the blade longitudinal direction.

Specifically, the blade portion 2 of the cleaning blade 1 of the present embodiment satisfies the relationship of $A<D$, more specifically the relationship of $1.0<D/A \leq 1.5$. As shown in FIG. 6, A is the thickness of the blade tip 21 at the central part in the blade longitudinal direction. D is the thickness of the blade tip 21 at two ends in the blade longitudinal direction. The other configuration is the same as that of the first embodiment.

Experimental Example

Hereinafter, the cleaning blade will be more specifically described using experimental examples.

<Preparation of Urethane Rubber Composition>

A predetermined amount of polybutylene adipate (PBA) ("Nipporan 4010", produced by Tosoh Corporation) and a predetermined amount of 4,4'-diphenylmethane diisocyanate (MDI) ("Millionate MT", produced by Tosoh Corporation) were mixed and reacted under $N_2$ purge at 80° C. for 180 minutes to prepare the main agent. Next, a predetermined amount of trimethylolpropane (TMP) or trimethylolpropane (TMP) and 1,4-butanediol (1,4BD), a predetermined amount of triethylenediamine (TEDA) (produced by Tosoh Corporation), and a predetermined amount of a metal catalyst ("K-KAT XK-627", produced by Kusumoto Chemicals, Ltd.) were mixed to prepare a curing agent. Then, in a vacuum atmosphere, the main agent and the curing agent were mixed at 60° C. for 1 minute and sufficiently degassed. Thereby, each urethane composition U1 to be used for manufacturing the blade portions in the cleaning blades of Samples 1 to 9 was prepared. Regarding the amount of each component with respect to the entire urethane composition U1, MDI was in a range of 28 to 40% by mass, TMP or TMP and 1,4BD was 4% by mass or less but TMP was 0.8% by mass or more, TEDA was in a range of 0.01 to 0.02% by mass, the metal catalyst was in a range of 0.01 to 0.02% by mass, and the rest was PBA.

A known urethane composition U2 was prepared as the urethane composition to be used for manufacturing the blade portions in the cleaning blades of Sample 1C and Sample 3C.

In the preparation of the urethane composition U1, the amount of MDI exceeded 40% by mass, and the amount of TMP or TMP and 1,4BD exceeded 5% by mass, by which a urethane composition U3 was prepared to be used for manufacturing the blade portion in the cleaning blade of Sample 2C.

<Manufacturing of Cleaning Blade Sample>

Figure 3:
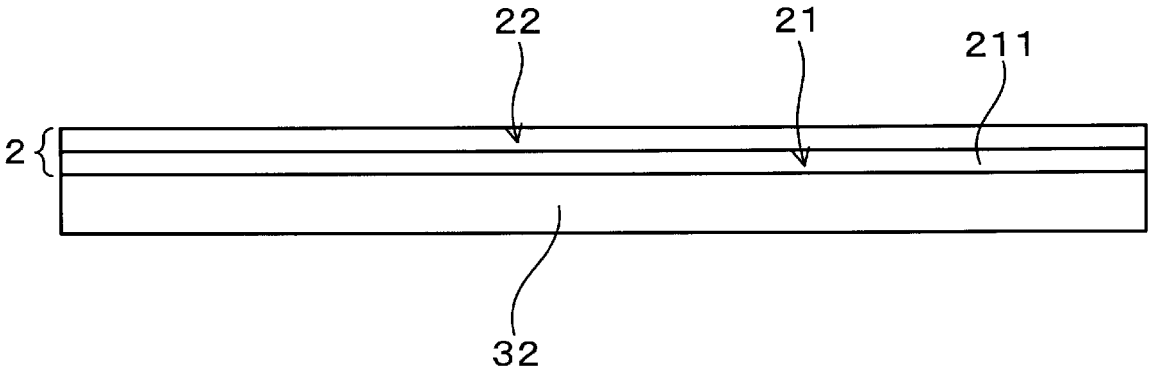
FIG. 3 is a view schematically showing the cleaning blade according to the first embodiment as viewed from the side of the blade tip surface.

The plate-shaped portion of the metallic support, which was made of a long metallic plate material bent into an L-shaped cross section, was disposed in a blade portion mold, which was adjusted to be able to give the predetermined values A, B, C, and D. Next, the predetermined urethane composition was poured into the mold and the mold was heated to 130° C. to cure the urethane composition, and then the mold was removed. Thereby, the cleaning blade of each sample was manufactured. The blade portions of the cleaning blades of Sample 1 to Sample 8 and Sample 1C to Sample 3C had blade tips having a constant thickness in the blade longitudinal direction as shown in FIG. 3. The blade portion of the cleaning blade of Sample 9 had a blade tip whose thickness at two ends in the blade longitudinal direction was larger than the thickness at the central part as shown in FIG. 6.

<Measurement of Physical Properties of the Cleaning Blade Sample>

—Measurement of International Rubber Hardness of the Blade Portion—

For samples collected from the blade tips, the international rubber hardness was measured by the international rubber hardness test method M under the measurement conditions of 25° C. and 50% RH using a Wallace microhardness tester, manufactured by H. W. WALLACE, in accordance with JIS K 6253.

—Values A, B, C, and D of the Blade Portion—

The values A, B, C, and D of the blade portion were measured to calculate the values A/B and D/A.

—Measurement of the Values a and b of the Blade Portion—

The values a and b of the blade portion were measured by the method described above. In addition, the moving image of the blade portion along the blade longitudinal direction was photographed for 5 minutes after the rotation of the photosensitive drum for measurement started.

<Evaluation>

—Leaking of Toner—

The cleaning blade was incorporated into a commercially available color laser printer ("HP LaserJet Enterprise Color M553dn", manufactured by HP Japan), and an intermittent operation was performed for 20000 sheets with a printing pattern at 1% ruled lines in an environment of 10° C.×10% RH. If the scraping ability of the cleaning blade remained and the toner and the external additive were not attached to the charging roll, it was considered as "A" as the leaking of toner was sufficiently suppressed. If the toner and the external additive were found on the charging roll but there was no defect in the image, slight leaking of toner was observed but it was within the allowable range, and it was considered as "B" as the leaking of toner was suppressed. If the charging roll was dirtied and caused a defect in the image, it was considered as "C" as the leaking of toner could not be suppressed.

—Turning Up of the Blade Portion—

The cleaning blade was incorporated into a commercially available color laser printer ("HP LaserJet Enterprise Color M553dn", manufactured by HP Japan), and the color laser printer printed 200 non-printing images (A4 size) continuously in an environment of 32.5° C.×85% RH. If the blade portion was not turned up during the printing, it was considered as "A" as the turning up of the blade portion was sufficiently suppressed. If the blade portion was turned up, it was considered as "C" as the turning up of the blade portion could not be suppressed.

—Squealing—

The cleaning blade was incorporated into a commercially available color laser printer ("HP LaserJet Enterprise Color M553dn", manufactured by HP Japan), and the color laser printer printed 500 non-printing images (A4 size) continuously in an environment of 15° C.×10% RH to confirm whether squealing (abnormal noise) occurred. At this time, an acceleration sensor was attached to the support, and the change over time of a specific frequency band during occurrence of the abnormal noise was also measured. If squealing did not occur, it was considered as "A" as squealing was sufficiently suppressed. If an increase in the peak of the specific frequency band was confirmed by the acceleration sensor but the squealing was at a level that could not be heard actually, it was within the allowable range and was considered as "B" as the squealing was suppressed. If squealing occurred, it was considered as "C" as the squealing could not be suppressed.

—Chipping—

The cleaning blade was incorporated into a commercially available color laser printer ("HP LaserJet Enterprise Color M553dn", manufactured by HP Japan), and an intermittent operation was performed for 20000 sheets with a printing pattern at 1% ruled lines in an environment of 10° C.×10% RH. Then, the blade tip was observed. If no chipping was found at all, it was considered as "A" as the chipping was sufficiently suppressed. If chipping occurred but the size was 5 μm or less, and there was no defect in the image, it was within the allowable range and was considered as "B" as the chipping was suppressed. If chipping occurred and caused a defect in the image, it was considered as "C" as the chipping could not be suppressed.

—Wearing of the Photosensitive Drum—

The cleaning blade was incorporated into a commercially available color laser printer ("HP LaserJet Enterprise Color M553dn", manufactured by HP Japan), and an intermittent operation was performed for 20000 sheets with a printing pattern at 1% ruled lines in an environment of 10° C.×10% RH. Then, the change of the film thickness of the photosensitive drum was measured. If the change of the film thickness of the photosensitive drum was 5 μm or less, it was considered as "A" as the wearing of the photosensitive drum was sufficiently suppressed. If the change of the film thickness of the photosensitive drum exceeded 5 μm, it was considered as "C" as the wearing of the photosensitive drum could not be suppressed.

Table 1 summarizes the detailed configuration, measurement result, and evaluation result of each cleaning blade sample.

TABLE 1

| | | | Sample 1 | Sample 2 | Sample 3 | Sample 4 | Sample 5 | Sample 6 |
|---|---|---|---|---|---|---|---|---|
| Blade portion | a | μm | 40 | 50 | 40 | 40 | 50 | 40 |
| | b | μm | 12 | 13 | 8 | 20 | 15 | 20 |
| | b/a | — | 0.3 | 0.3 | 0.2 | 0.5 | 0.3 | 0.5 |
| | A | mm | 1.1 | 0.9 | 1.1 | 1.1 | 0.9 | 1.4 |
| | B | mm | 3.1 | 3.1 | 3.1 | 3.1 | 3.1 | 3.1 |
| | C | mm | 2.0 | 2.0 | 2.0 | 2.0 | 2.0 | 2.0 |
| | D | mm | 1.1 | 0.9 | 1.1 | 1.1 | 0.9 | 1.4 |
| | A/B | — | 0.35 | 0.29 | 0.35 | 0.35 | 0.26 | 0.45 |
| | D/A | — | 1.0 | 1.0 | 1.0 | 1.0 | 1.0 | 1.0 |
| | International Rubber Hardness | IRHD | 85 | 85 | 90 | 80 | 85 | 85 |
| Evaluation | Leaking of toner | | A | B | A | B | B | B |
| | Turning up of blade portion | | A | A | A | A | A | A |
| | Occurrence of squealing (abnormal noise) | | A | A | A | B | A | B |
| | Chipping | | ,A | A | B | A | A | A |
| | Wearing of photosensitive drum | | A | A | A | A | A | A |

| | | | Sample 7 | Sample 8 | Sample 9 | Sample 1C | Sample 2C | Sample 3C |
|---|---|---|---|---|---|---|---|---|
| Blade portion | a | μm | 40 | 40 | 45 | 80 | 40 | 40 |
| | b | μm | 8 | 20 | 13 | 28 | 2 | 32 |
| | b/a | — | 0.2 | 0.5 | 0.3 | 0.35 | 0.05 | 0.8 |

TABLE 1-continued

| | | | | | | | | |
|---|---|---|---|---|---|---|---|---|
| | A | mm | 1.1 | 1.1 | 1.1 | 1.1 | 1.1 | 1.55 |
| | B | mm | 3.1 | 3.1 | 3.1 | 3.1 | 3.1 | 3.1 |
| | C | mm | 1.0 | 2.5 | 2.0 | 2.0 | 2.0 | 2.0 |
| | D | mm | 1.1 | 1.1 | 1.65 | 1.1 | 1.1 | 1.55 |
| | A/B | — | 0.35 | 0.35 | 0.35 | 0.35 | 0.35 | 0.50 |
| | D/A | — | 1.0 | 1.0 | 1.5 | 1.0 | 1.0 | 1.0 |
| | International Rubber Hardness | IRHD | 85 | 85 | 85 | 75 | 95 | 85 |
| Evaluation | Leaking of toner | | A | B | A | C | C | A |
| | Turning up of blade portion | | A | A | A | C | A | A |
| | Occurrence of squealing (abnormal noise) | | A | B | A | A | A | C |
| | Chipping | | B | A | A | A | C | A |
| | Wearing of photosensitive drum | | A | A | A | A | C | A |

According to Table 1, the following can be understood. Regarding the cleaning blade of Sample 1C, the value a exceeded the upper limit. Therefore, the edge had an excessively large amplitude, and the leaking of toner and the turning up of the blade portion occurred.

Regarding the cleaning blade of Sample 2, the value b/a dropped below the lower limit. Therefore, the amplitude at the position P that vibrated with the vibration of the edge became excessively small with respect to the amplitude of the edge, and an excessive contact pressure was applied on the photosensitive drum, so wearing of the photosensitive drum occurred. In addition, the blade tip was chipped and the durability against chipping dropped. The reason is considered to be that as the value b/a dropped below the lower limit, the stretch of the blade tip deteriorated and the brittleness also increased. Moreover, the chipping also caused leaking of the toner.

Regarding the cleaning blade of Sample 3, the value b/a exceeded the upper limit. Therefore, the amplitude at the position P that vibrated with the vibration of edge became excessively large with respect to the amplitude of the edge, and squealing occurred during cleaning.

In contrast to these, in terms of the cleaning blades of Sample 1 to Sample 9, the maximum value a of the amplitude of the edge of the blade tip and the maximum value b of the amplitude of the position P that vibrates with the vibration of the edge are set to satisfy the above-mentioned specific relationship. Therefore, according to the cleaning blades of Sample 1 to Sample 9, with the focus on each of the above amplitudes, it is possible to simultaneously suppress the leaking of toner, the turning up, squealing, and chipping of the blade portion, and wearing of the photosensitive drum.

Furthermore, it is understood that when the values A/B, C, and the international rubber hardness of the blade portion are within the above specific ranges, the cleaning blades of Sample 1 to Sample 9 easily ensure the above-mentioned effect.

In addition, it is understood that when the cleaning blade of Sample 9 is compared with the cleaning blade of Sample 2 that has a relatively similar blade portion configuration, by satisfying the relationship of A<D, it is easy to suppress the leaking of toner for the above reason.

Further, according to the cleaning blade of Sample 9, with the value D/A set to 1.5, the cleaning blade has an excellent effect in suppressing the leaking of toner. Therefore, it was also confirmed that the effect can be sufficiently achieved if the value D/A is set more than 1.0 and equal to or less than 1.5.

In summary, for the cleaning blade, the maximum value a of the amplitude of the edge of the blade tip and the maximum value b of the amplitude of the position P that vibrates with the vibration of the edge are set to satisfy the above-mentioned specific relationship. Therefore, with the cleaning blade, it is possible to simultaneously suppress the leaking of toner, the turning up, squealing, and chipping of the blade portion, and wearing of the photosensitive drum.

Although the embodiments of the disclosure have been described in detail above, the disclosure is not limited to the above embodiments and experimental examples, and it is possible to make various changes without impairing the spirit of the disclosure.

What is claimed is:

1. A cleaning blade used to remove residual toner that remains on a surface of a photosensitive drum in an electrophotographic apparatus, the cleaning blade comprising:

a blade portion, having a blade tip that comprises an edge constituted by a ridge line between a tip surface of the blade portion and a blade surface arranged on a side of the photosensitive drum; and a support holding the blade portion, wherein the blade portion satisfies a relationship of $a \leq 50$ μm and $0.1 \leq b/a \leq 0.6$, where, when the blade portion with the edge in sliding contact with the photosensitive drum, which rotates in one direction, is viewed along a blade longitudinal direction, a represents a maximum value of an amplitude of the edge, which vibrates with rotation of the photosensitive drum, and b represents a maximum value of an amplitude when a position P that is on the blade surface of the blade tip and separate from the edge by 200 μm vibrates with vibration of the edge, wherein the blade portion comprises a blade base connected to the support, and satisfies a relationship of $0.26 \leq A/B \leq 0.48$ and 1 mm$\leq C \leq$3 mm, and has an international rubber hardness of 80 IRHD or more and 90 IRHD or less, where A represents a thickness of the blade tip at a central part in the blade longitudinal direction, B represents a thickness of the blade base at the central part in the blade longitudinal direction, and C represents a blade surface length of the blade tip at the central part in the blade longitudinal direction, wherein the blade portion satisfies a relationship of A<D, where D represents a thickness of the blade tip at two ends in the blade longitudinal direction, wherein the blade portion satisfies a relationship of $1.0<D/A\leq 1.5$.

* * * * *